US006263528B1

(12) United States Patent
Hüsler

(10) Patent No.: US 6,263,528 B1
(45) Date of Patent: Jul. 24, 2001

(54) LEANING OR SITTING DEVICE

(76) Inventor: Balthasar Hüsler, Murmeliweg 6, CH-4538 Oberbipp (CH)

( * ) Notice: Subject to any disclaimer, the term of this patent is extended or adjusted under 35 U.S.C. 154(b) by 0 days.

(21) Appl. No.: 09/600,453

(22) PCT Filed: Jan. 18, 1999

(86) PCT No.: PCT/CH99/00021

§ 371 Date: Sep. 22, 2000

§ 102(e) Date: Sep. 22, 2000

(87) PCT Pub. No.: WO99/35940

PCT Pub. Date: Jul. 22, 1999

(30) Foreign Application Priority Data

Jan. 16, 1998 (CH) ..... 105/98

(51) Int. Cl.[7] ..... A47C 27/16; A47C 27/14; A47C 23/06

(52) U.S. Cl. ..... 5/236.1; 5/737

(58) Field of Search ..... 5/236.1, 237, 238, 5/737, 738

(56) References Cited

FOREIGN PATENT DOCUMENTS 41 14 417 A1 11/1992 (DE) .

0 243 383 B1 5/1989 (EP) .

OTHER PUBLICATIONS

WO 87/02559, Installation for Resting and Lying Down, preferably for a Bed, May 7, 1987.

WO 96/28072, Wooden Slatwork for Beds and Chairs, Sep. 19, 1996.

*Primary Examiner*—Alexander Grosz
(74) *Attorney, Agent, or Firm*—Rankin, Hill, Porter & Clark LLP

(57) ABSTRACT

A device for lying on or sitting on comprising a mattress (3) with a mattress sheath (4), a lath grid (1, 2) and at least two springy beams (5) extending in longitudinal direction of the device, wherein the lath grid (1, 2) comprises a lath grid cloth (1) with means for fixing laths (2) to one side of the lath grid cloth (1) in a transverse direction of the device and parallel to each other, and wherein the mattress (3) and the lath grid (1, 2) are connected by two detachable connection means extending in a longitudinal direction of the device, to form a mattress/grid-unit being substantially wholly covered with cloth, wherein the two connection means comprises each a pair of cooperating parts (14, 44) of which parts (14, 44) a first part (44) is fixed to the mattress sheath (4) and a second part (14) is fixed to the lath grid cloth (1).

11 Claims, 3 Drawing Sheets

LEANING OR SITTING DEVICE

The invention relates to a device for lying or sitting according to the generic part of the first independent claim. The inventive device comprises a mattress, a lath grid being flexible in the direction of its length and a springy support for the lath grid. If the device is to be applicable not only for lying but also for sitting it is usually narrower and comprises a back extending along its length.

From the publication EP-0243383, a device for lying is known which device is light and of a simple design and which all the same offers a high lying comfort even when used with a thin mattress only. This device for lying comprises a lath grid having a plurality of parallel laths extending perpendicular to the length of the device, which laths rest on at least two springy longitudinal beams. The laths and the springy longitudinal beams are connected to each other and kept in place relative to each other by means of a lath grid cloth. This lath grid cloth has substantially the rectangular form of the lying device and comprises means for fixing the laths, e.g. rows of lath pockets running along its longer edges, and tunnel-like sheaths for the springy beams. The lath grid cloth is dimensioned in such a way that it is tensioned perpendicular to its length by the laths positioned each in two opposite pockets. Lath grid cloth, laths and beams form together a light and still stable unit which is flexible in the direction of its length and can e.g. be rolled up. All the same the unit can easily be taken to pieces for cleaning purposes or if necessary for exchanging parts of it. For use, the cloth/lath/beam-unit is advantageously covered with an only thin mattress consisting e.g. of latex. For use, the device for lying is positioned directly on the floor or on a support structure or on the beams of a bed frame.

Publication DE-4114417 show a similar device for lying or sitting, which device comprises two lateral ribbons for fixing the laths in a lath grid.

The publication WO-96/28072 (exchangeable lath) deals in particular with specific embodiments of pocket rows for positioning laths. In the same publication sheaths for mattresses are described having integrated pocket rows. In such an embodiment the laths are fixed in pockets directly on the bottom side of the mattress and mattress an laths form a unit which is positioned on separate springy beams. This embodiment is particularly suitable for being used with fixed sheets which are positioned in a tensioned manner around the mattress/lath-unit.

The object of the invention is to improve, regarding ease of handling, the device for lying as shortly described above without though reducing its lying comfort and without rendering fabrication more complicated.

This object is achieved by the device for lying as defined by the independent claim.

The inventive device for lying which is used positioned directly on the floor or on a support frame or on the beams of a bed frame comprises the following parts: a mattress, a sheath for the mattress, a plurality of laths, a lath grid cloth with lath fixing means, e.g. lateral pocket rows, at least two springy longitudinal beams and possibly sheaths for the beams made of cloth. The lath grid cloth and the beam sheaths may be connected to each other in a permanent or detachable manner. The mattress sheath and the lath grid cloth are connected to each other in a detachable manner by detachable connection means such that the lengthwise flexible lath grid can be fixed to the bottom side of the mattress the laths being positioned between the mattress and the lath grid cloth. An important feature of the inventive device for lying is therefore the unit comprising lath grid and mattress which unit can be separated into its parts very easily and which unit is covered substantially on all its sides by cloth (mattress sheath and lath grid cloth).

The inventive device for lying is described in detail in connection with the following Figures, wherein.

Figure 1:
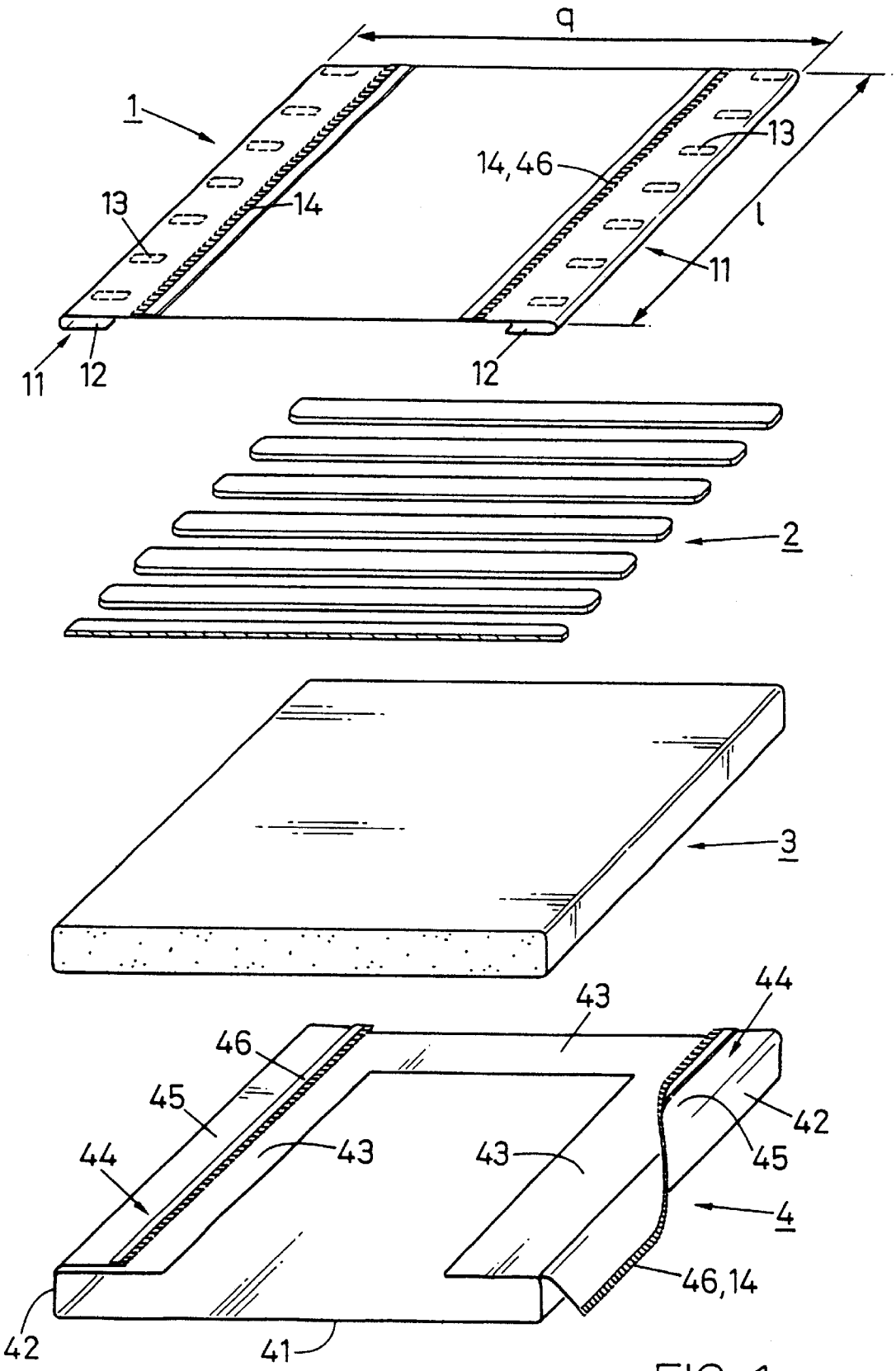
FIG. 1 shows the four main parts of the inventive device for lying or sitting: lath grid cloth, laths, mattress and mattress sheath.

FIG. 1 shows an exemplified embodiment of the main parts of the inventive device for lying: a lath grid cloth 1 with lateral pocket rows 11, a plurality of laths 2 to be positioned parallel to each other and in transverse direction of the device, a mattress 3 and a mattress sheath 4 made of cloth. These main parts are shown in section perpendicular to the length of the device, the section plane being positioned towards the viewer, wherein all parts are shown only partially, the shown parts having a width q (substantially the width of the device) and a partial length 1. The parts are shown in a sequence from top to bottom as present in the device from bottom to top.

The mattress 3 is e.g. a latex sheet having a thickness of 5 to 10 cm. The mattress sheath 4 e.g. consists of a stable cotton cloth and comprises a complete mattress upper side cover 41, on all sides of the upper side cover, narrow side covers 42 and a bottom side cover 43. The bottom side cover 43 comprises at least a cloth strip running along all bottom edges of the mattress and being fixed to the narrow side covers 42. As shown in FIG. 1, the middle part of the bottom side of the mattress positioned in the mattress sheath 4 may be uncovered.

The whole mattress sheath may consist as mentioned further above of a stable cotton cloth. However, it is possible also that at least the upper side cover 41 is made of a wool cloth or of a stitched combination of a double wool knit with a carded wool fleece inbetween or of a corresponding stitched combination of cotton. Such a part of a mattress sheath may take over the function of a separate blanket-like item to be put on the mattress.

Furthermore, the mattress sheath 4 comprises in the region of both its lower longitudinal edges a part 44 of a longitudinal connection means, e.g. on each side a cloth strip 45 with one part of a completely separable zip 46, which parts of longitudinal connection means cooperate with corresponding parts 14 of longitudinal connection means fixed to the lath grid cloth.

The parts 44 of longitudinal connection means of the mattress sheath 4 extend either as shown strip-like along the full length of the mattress sheath 4 and are fixed on the mattress sheath 4 in the region of the lower longitudinal edges and around the mattress corners along part of the lower transversal edges. They are e.g. fixed in the stitching of the edge seams of the mattress sheath 4.

The effective connection means is as mentioned above e.g. a completely separable zip 46. However, it may also be a strip of a bur fastener or a reversible glue connection or a row of button holes and buttons or of eyes and hooks or a row of snap fasteners.

The longitudinal connection means may also comprise a plurality of part connections spread out over the mattress length and not extending to the mattress corners. Such part connections may e.g. be ribbons for tying, ribbons with buckles or ribbons with buttons being fixed at a distance from each other to the longitudinal lower edges of the mattress sheath (see also FIG. 6).

The lath grid cloth 1 has substantially the same length and width as the mattress 3 or is a little smaller than the mattress. Lateral pocket rows 11 are provided for fixing the laths. The pockets are e.g. formed by a cloth fold-over 12 extending along the longitudinal edges and being transversely stitched at regular distances (locations 13) to form pockets. The pocket openings are positioned on the one side of the lath grid cloth 1 to be facing towards the mattress. The parts 14 of longitudinal connection means cooperating with parts of longitudinal connection means 44 on the mattress sheath 4, are fixed to the other side of the lath grid cloth (facing away from the mattress) and at a distance from the pocket rows more towards the middle of the lath grid cloth 1. Parts of completely separable zips are shown as examples of such longitudinal connection means. These zip parts are connectable to corresponding zip parts 46 on the mattress sheath 4.

The laths 2 are shown positioned in the same way as they are positioned between the mattress 3 or the lover side cover 43 of the mattress sheath 4 respectively and the lath grid cloth 1, wherein their ends are positioned in the pockets of the pocket rows 11. The laths 2 are advantageously slightly longer than the distance between two opposite pockets such that they are able to tension the lath grid cloth 1.

Figure 2:
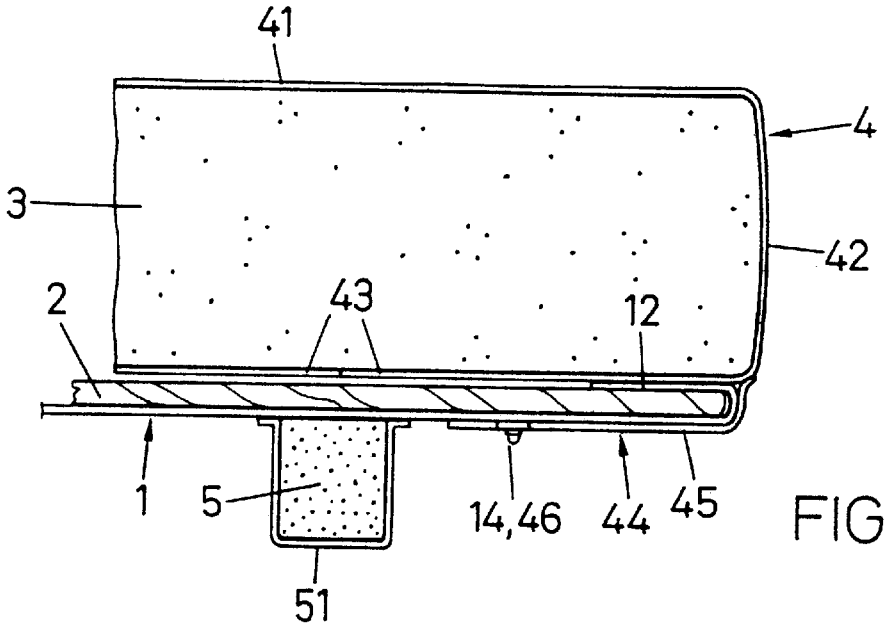
FIG. 2 is a cross section of an exemplified embodiment of the inventive device.

FIG. 2 is a part of a cross section through the inventive device for lying, which is made by connecting the parts as shown in FIG. 1. Same parts are denominated with same reference numerals as in FIG. 1. In addition, there is shown a springy longitudinal beam 5, which is e.g. positioned within a tunnel-like beam sheath 51 being fixed to the lath grid cloth 1. The whole assembly is a mattress/grid/beam-unit covered on all sides by cloth.

Figure 3:
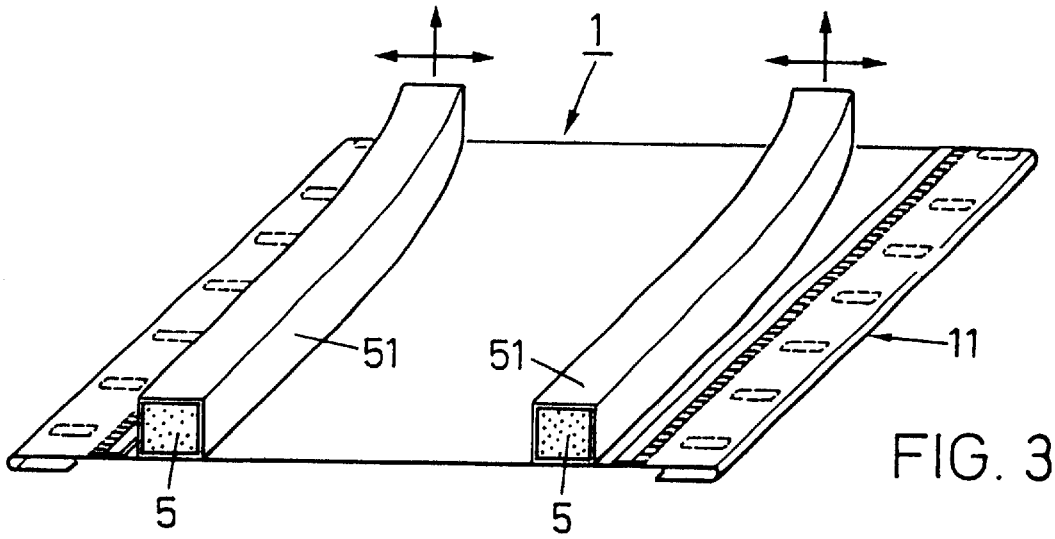
FIG. 3 shows a further embodiment of the lath grid cloth which comprises additional means for sheathing the springy longitudinal beams.

FIG. 3 shows in the same manner as FIG. 1 a lath grid cloth 1 with lateral pocket rows 11 and with tunnel-like beam sheaths 51 and springy longitudinal beams 5 positioned therein. The springy beams 5 may consist of latex. The beam sheaths 51 may be fixed to the lath grid cloth in a permanent or detachable manner. In order to adapt a mattress/grid/beam-unit to the use of fix sheets, i.e. sheets being tensioned by an elastic on the lower side of a mattress (or a mattress/grid/beam-unit), it is advantageous to not fix the ends of the beam sheaths 51 (foot and head end of the lying device) to the lath grid cloth in order to enable the sheet to be positioned between the lath grid cloth 1 and the longitudinal beam 5.

The beam sheaths 51 are e.g. stitched to the lath grid cloth 1 as indicated in FIGS. 2 and 3, wherein the lath grid cloth 1 constitutes one side of the beam sheaths. The beam sheaths may also be closed and fixed to the lath grid cloth by strips of bur fastener or by a plurality of spaced apart other connection means.

It is no condition for the inventive device for the springy longitudinal beams to be fixed to the lath grid cloth 1. The beams may instead be used as separate items preferably also encased in suitable sheaths. The beams may also be connected in a suitable manner to a support frame or to beams of a bed frame.

Figure 4:
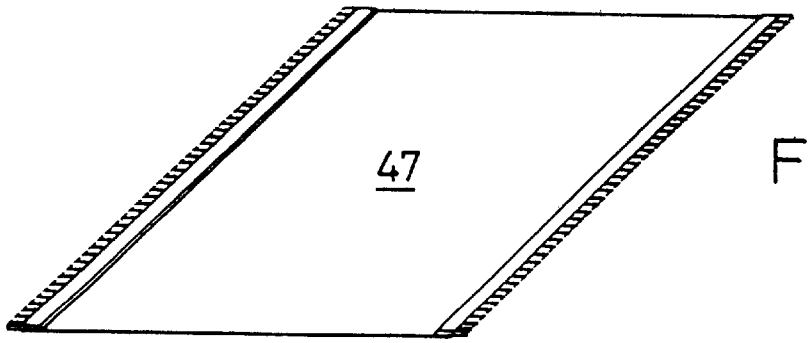
FIG. 4 shows a further cloth as a further possible part of the inventive device.

FIG. 4 shows a separate mattress under side cover 47, which may belong to a kit for an inventive device. The mattress under side cover 47 consists e.g. of the same cloth as the mattress sheath 4 and comprises fixed along its longitudinal edges parts of longitudinal connection means in the same manner as the lath grid cloth 1 does. When the mattress belonging to the inventive device is to be used separately, i.e. not as a mattress/grid-unit, the mattress positioned in the sheath can be covered on the bottom side by connecting the parts of connection means on the mattress sheath with the corresponding parts on the mattress bottom side cover 47. For this purpose e.g. corresponding zip parts are coupled and the zips are closed.

Figure 5:
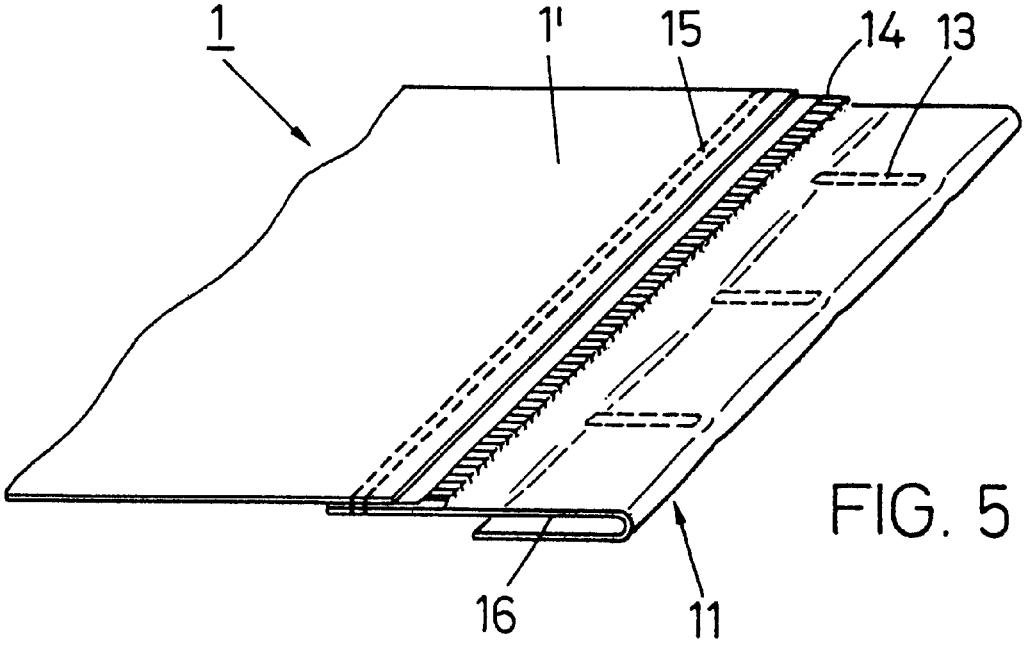
FIG. 5 shows an enlarged detail of the lath grid cloth with pocket rows and longitudinal connection means.

FIG. 5 shows a detail of an exemplified embodiment of the lath grid cloth 1 with pocket rows 11 and with a part 14 of a longitudinal connection means being a zip part. The pocket row 11 is a double ribbon or a longitudinally folded ribbon being stitched transversally in regular intervals. The pocket ribbon 16 is fixed to the longitudinal edges of the middle portion 1' of the lath grid cloth 1 by means of the longitudinal seam 15. The same seam 15 fixes also the zip part between the middle cloth portion 1' and the pocket ribbon 16.

Embodiments of lath grid cloths 1 with pocket rows 11 being designed as separately manufactured pocket ribbons 16 are in particular advantageous, for pockets such designed that the absolute length of the pocket row is shorter when lath ends are positioned in the pockets than it is when no lath ends are positioned in the pockets. This is always the case for pocket rows being made by transversal stitching of a non-elastic double ribbon. The middle cloth portion 1' is cut to a length to correspond to the length of the device for lying and the pocket ribbon is longer by the amount of length loss to be expected caused by positioning the lath ends into the pockets. When stitching the longitudinal seams 15, transport of the pocket ribbon is made larger than transport of the middle cloth portion 1' and of the zip part such that the additional length of the pocket ribbon 16 is regularly distributed along the length of the cloth, which in view of the length difference is easily possible without producing folds in the longitudinal seam 15. In an inventive device for lying comprising a lath grid cloth 1 with pocket rows according to FIG. 5 the middle cloth portion 1' will lie tightly and without folds against the bottom side of the mattress.

A further advantageous embodiment of the process for making the lath grid cloth 1 with pocket rows 11, as shown in FIG. 5, comprises the steps of producing pocket ribbons as described further above, fixing a zip part 14 to the pocket ribbon such that the pocket ribbon is longer than the zip part and that the additional length is distributed evenly along the length of the zip part. Such prepared pocket ribbons are then fixed to the middle cloth portion 1' by additional stitching.

In the described manner, the long known problem of the shortening of pocket rows caused by the laths positioned in the pockets is solved in a simple and elegant manner and the lath grid cloth such produced is able to lie flat in longitudinal direction.

Figure 6:
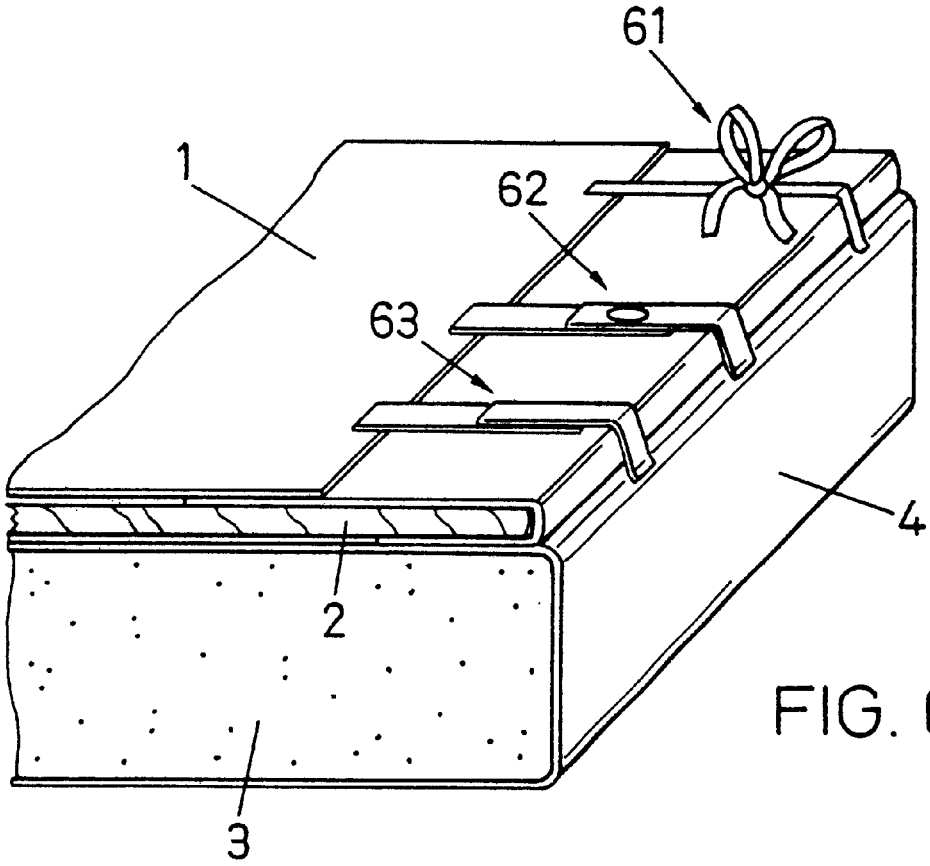
FIG. 6 shows further exemplified embodiments of longitudinal connection means.

FIG. 6 shows a plurality of further embodiments of longitudinal connection means being distanced from each other and being applicable instead of the zips as shown in FIGS. 1, 2 and 5. As mentioned further above these connection means are pairs of ribbons 61 to be tied, of ribbons 62 with a connection of button hole and button, snap fastener or buckles or ribbons with bur fasteners, wherein one part is always fixed to the mattress sheath and the other one to the lath grid cloth.

What is claimed is:

1. A device for lying or sitting, the device comprising a mattress (3) with a mattress sheath (4), a lath grid (1, 2) and at least two springy beams (5) extending in longitudinal direction of the device, wherein the lath grid (1, 2) comprises a lath grid cloth (1) with means for fixing laths (2) to one side of the lath grid cloth (1) in a transverse direction of the device and parallel to each other, and wherein the mattress (3) and the lath grid (1, 2) are connected by two detachable connection means extending in a longitudinal direction of the device, to form a mattress/grid-unit being substantially wholly covered with cloth, wherein the two connection means comprises each a pair of cooperating parts (14, 44) of which parts (14, 44) a first part (44) is fixed to the mattress sheath (4) and a second part (14) is fixed to the lath grid cloth (1).

2. The device for lying or sitting according to claim 1, wherein the means for fixing the laths along the longitudinal edges of the lath grid cloth (1) are pocket rows (11) comprising pockets with pocket openings on the one side of the lath grid cloth facing towards the mattress (3).

3. The device for lying or sitting according to claim 1, wherein the mattress sheath (4) comprises a mattress upper side cover (41), narrow side covers (42) and a mattress bottom side cover (43), that the first parts of the connection means (44) are fixed to the mattress sheath (4) in the transition area between the longitudinal edges of the mattress bottom side cover (43) and the narrow side covers (42) and that the second parts (14) of the connection means are fixed to the one side of the lath grid cloth which is facing away from the mattress(3).

4. The device for lying or sitting according to claim 1, wherein the pairs of first and second cooperating parts (14/44) of longitudinal connection means are parts of fully detachable zips (46), bur fastenings, rows of buttons or snap fasteners, which are fixed to cloth strips extending along at least part of the length of the device.

5. The device for lying or sitting according to claim 1, wherein the pairs of first and second cooperating parts of longitudinal connection means are pairs of ribbons (61, 62, 63) distanced from each other, which ribbons carry buttons or button holes respectively or eyes, snap fasteners, bur fasteners or buckles or are suited for being tied together.

6. The device for lying or sitting according to claim 1, wherein the lath grid cloth (1) comprises a middle cloth portion (1') having the length of the device and wherein pocket ribbons (16) are fixed to the middle cloth portion (1') by means of longitudinal seams (15) wherein the length of the pocket ribbons (16) is larger than the length of the middle cloth portion (1') and wherein the longitudinal seams (15) are made such that the additional length of the pocket ribbons (16) is distributed evenly along the length of the middle cloth portion (1').

7. The device for lying or sitting according to claim 6, wherein the longitudinal seams (15) not only connect the middle cloth portion (1') and the pocket ribbon (16) but also a zip part (46), wherein the zip part (46) has the same length as the middle cloth portion (1').

8. The device for lying or sitting according to claim 1, wherein the lath grid cloth (1) to the one side of which the means for fixing the laths are fixed comprises, on its other side, beam sheaths (51) or means for fixing beam sheaths.

9. The device for lying or sitting according to claim 1, wherein the mattress sheath (4) comprises a mattress bottom side cover (43) consisting of cloth strips fixed to the narrow side covers (42) such that a middle portion of the mattress (3) is not covered by the mattress sheath (4).

10. The device for lying or sitting according to claim 1, wherein the mattress sheath (4) and the lath grid cloth (1) are formed from cotton cloth.

11. The device for lying or sitting according to claim 1, wherein the mattress sheath (4) comprises at least a mattress upper side cover (41) formed from wool cloth or of a stitched combination of two layers of wool or cotton knit and a layer of carded fleece of wool or cotton between said layers of wool or cotton knit.

* * * * *